US010473418B2

(12) United States Patent
Shaffer et al.

(10) Patent No.: US 10,473,418 B2
(45) Date of Patent: Nov. 12, 2019

(54) POWER CORD ADJUSTMENT

(71) Applicant: Hunter's Manufacturing Company, Inc., Suffield, OH (US)

(72) Inventors: Michael Shaffer, Mogadore, OH (US); Jacob Hout, Akron, OH (US); Dean Mook, Suffield, OH (US); Gary Smith, East Canton, OH (US); Phil Bednar, Copley, OH (US); Steve Bednar, Copley, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 0 days.

(21) Appl. No.: 15/942,654

(22) Filed: Apr. 2, 2018

(65) Prior Publication Data

US 2019/0025005 A1 Jan. 24, 2019

Related U.S. Application Data

(60) Provisional application No. 62/533,845, filed on Jul. 18, 2017.

(51) Int. Cl.
*F41B 5/12* (2006.01)

(52) U.S. Cl.
CPC ..... *F41B 5/123* (2013.01)

(58) Field of Classification Search
CPC ..... F41B 5/12; F41B 5/123
USPC ..... 124/25
See application file for complete search history.

(56) References Cited

U.S. PATENT DOCUMENTS

| | | | | |
|---|---|---|---|---|
| 2,092,361 | A | 9/1937 | Shim | |
| 3,043,287 | A | 7/1962 | Nelson | |
| 3,561,419 | A | 2/1971 | Cucuzza, Sr. | |
| 3,670,711 | A | 6/1972 | Firestone | |
| 3,739,765 | A | 6/1973 | Moore | |
| 4,192,281 | A | 3/1980 | King | |
| 4,246,883 | A | 1/1981 | Ash | |
| 4,593,675 | A | 6/1986 | Waiser | |
| 4,603,676 | A | 8/1986 | Luoma | |
| 4,649,891 | A * | 3/1987 | Bozek | F41B 5/123 124/25 |
| 4,649,892 | A | 3/1987 | Bozek | |
| 4,662,345 | A | 5/1987 | Stephens | |

(Continued)

OTHER PUBLICATIONS

A Guide to the Crossbow, by W.F. Paterson, published by the Society of Archer-Antiquaries, 1990.

(Continued)

*Primary Examiner* — Alexander R Niconovich
(74) *Attorney, Agent, or Firm* — Emerson Thomson Bennett, LLC

(57) ABSTRACT

Provided is a crossbow comprising a bow having a riser having a first side and a second side opposite the first side, a first limb set engaged to the first side, a second limb set engaged to the second side, a first cam set engaged to the first limb set, a second cam set engaged to the second limb set; an adjustable pulley set having at least a first pulley and a second pulley, wherein the pulley set is operationally engaged with and selectably movable with respect to the first cam, or the second cam, or the riser; a first power cord set extending from the first cam set and at least partially around the first pulley; and a second power cord set extending from the second cam set and at least partially around the second pulley.

15 Claims, 9 Drawing Sheets

(56) References Cited

U.S. PATENT DOCUMENTS

| | | | | |
|---|---|---|---|---|
| 4,665,885 | A | 5/1987 | Glomski et al. | |
| 4,719,897 | A | 1/1988 | Gaudreau | |
| 4,721,092 | A | 1/1988 | Waiser | |
| 4,766,874 | A * | 8/1988 | Nishioka | F41B 5/12 124/25 |
| 4,879,987 | A * | 11/1989 | Nishioka | F41B 5/123 124/25 |
| 4,917,071 | A * | 4/1990 | Bozek | F41B 5/12 124/24.1 |
| 4,942,861 | A | 7/1990 | Bozek | |
| 5,115,795 | A | 5/1992 | Farris | |
| 5,205,267 | A | 4/1993 | Burdick | |
| 5,215,069 | A | 6/1993 | Liu | |
| 5,220,906 | A | 6/1993 | Choma | |
| 5,243,956 | A | 9/1993 | Luehring | |
| 5,433,186 | A | 7/1995 | Corwin | |
| 5,437,260 | A | 8/1995 | King | |
| 5,445,139 | A | 8/1995 | Bybee | |
| 5,553,596 | A | 9/1996 | Bednar | |
| 5,598,829 | A | 2/1997 | Bednar | |
| 5,649,520 | A | 7/1997 | Bednar | |
| 5,678,528 | A | 10/1997 | Hadley | |
| 5,853,001 | A * | 12/1998 | Vyprachticky | F41B 5/14 124/88 |
| 5,987,724 | A | 11/1999 | Kleman | |
| 6,095,128 | A | 8/2000 | Bednar | |
| 6,286,496 | B1 | 9/2001 | Bednar | |
| 6,776,148 | B1 * | 8/2004 | Islas | F41B 5/10 124/25.6 |
| 6,874,491 | B2 | 4/2005 | Bednar | |
| 6,913,007 | B2 | 7/2005 | Bednar | |
| 7,100,590 | B2 | 9/2006 | Chang | |
| 7,578,289 | B2 * | 8/2009 | Norkus | F41B 5/0094 124/25 |
| 7,624,725 | B1 | 12/2009 | Choma | |
| 7,784,453 | B1 | 8/2010 | Yehle | |
| 7,891,348 | B2 * | 2/2011 | Colley | F41B 5/123 124/25 |
| 8,387,604 | B1 * | 3/2013 | Terzo | F41B 5/123 124/23.1 |
| 8,443,790 | B2 | 5/2013 | Pestrue | |
| 8,499,753 | B2 | 8/2013 | Bednar | |
| 8,651,095 | B2 * | 2/2014 | Islas | F41B 5/105 124/25 |
| 9,234,719 | B1 * | 1/2016 | Kempf | F41B 5/105 |
| 9,243,861 | B1 * | 1/2016 | Kempf | F41B 5/12 |
| 9,377,267 | B1 * | 6/2016 | Kempf | F41B 5/105 |
| 9,513,080 | B1 * | 12/2016 | Kempf | F41B 5/123 |
| 9,829,268 | B1 * | 11/2017 | Kempf | F41B 5/123 |
| 9,879,938 | B1 * | 1/2018 | Isenhower | F41B 5/123 |
| 10,018,442 | B1 * | 7/2018 | Kempf | F41B 5/123 |
| 10,267,592 | B2 * | 4/2019 | Bartels | F41B 5/123 |
| 2006/0086346 | A1 | 4/2006 | Middleton | |
| 2010/0170488 | A1 | 7/2010 | Rasor et al. | |
| 2011/0056467 | A1 * | 3/2011 | Popov | F41B 5/0094 124/25.6 |
| 2015/0285581 | A1 * | 10/2015 | Chang | F41B 5/123 124/25 |

OTHER PUBLICATIONS

European Crossbows, A Survey by Josef Alm, copyrighted by the Trustees of the Royal Armouries and the Arms and Armour Society, 1994.

The Book of the Crossbow, by Ralph Payne-Gallwey, published by Dover Publications, Inc. of New York, 1995.

* cited by examiner

POWER CORD ADJUSTMENT

CROSS-REFERENCE TO RELATED APPLICATIONS

This application claims the benefit of U.S. Provisional Application No. 62/533,845, filed Jul. 18, 2017, the entirety of which is fully incorporated by reference herein.

BACKGROUND

The present subject matter is directed to apparatuses and methods regarding crossbows. More specifically the present subject matter is directed to apparatuses and methods for adjustment of the power cord of a crossbow.

Crossbows have been used for many years as a weapon for hunting and fishing, and for target shooting. Crossbows typically comprise a bowstring engaged through set of pulleys to a set of limbs and to a set of power cords. Engagement of the power cords is of interest. It is of interest to make the engagement of the power cords reliable, light, inexpensive, low maintenance, safe, and adjustable.

It remains desirable to improve the apparatuses and methods by which the engagement of the power cords may be adjustable.

SUMMARY

Provided is a crossbow comprising a bow having a riser having a first side and a second side opposite the first side, a first limb set engaged to the first side, a second limb set engaged to the second side, a first cam set engaged to the first limb set, a second cam set engaged to the second limb set; an adjustable pulley set having at least a first pulley and a second pulley, wherein the pulley set is operationally engaged with and selectably movable with respect to the first cam, or the second cam, or the riser; a first power cord set extending from the first cam set and at least partially around the first pulley; and a second power cord set extending from the second cam set and at least partially around the second pulley.

BRIEF DESCRIPTION OF THE DRAWINGS

The present subject matter may take physical form in certain parts and arrangement of parts, embodiments of which will be described in detail in this specification and illustrated in the accompanying drawings which form a part hereof and wherein.

DEFINITIONS

Figure 1:
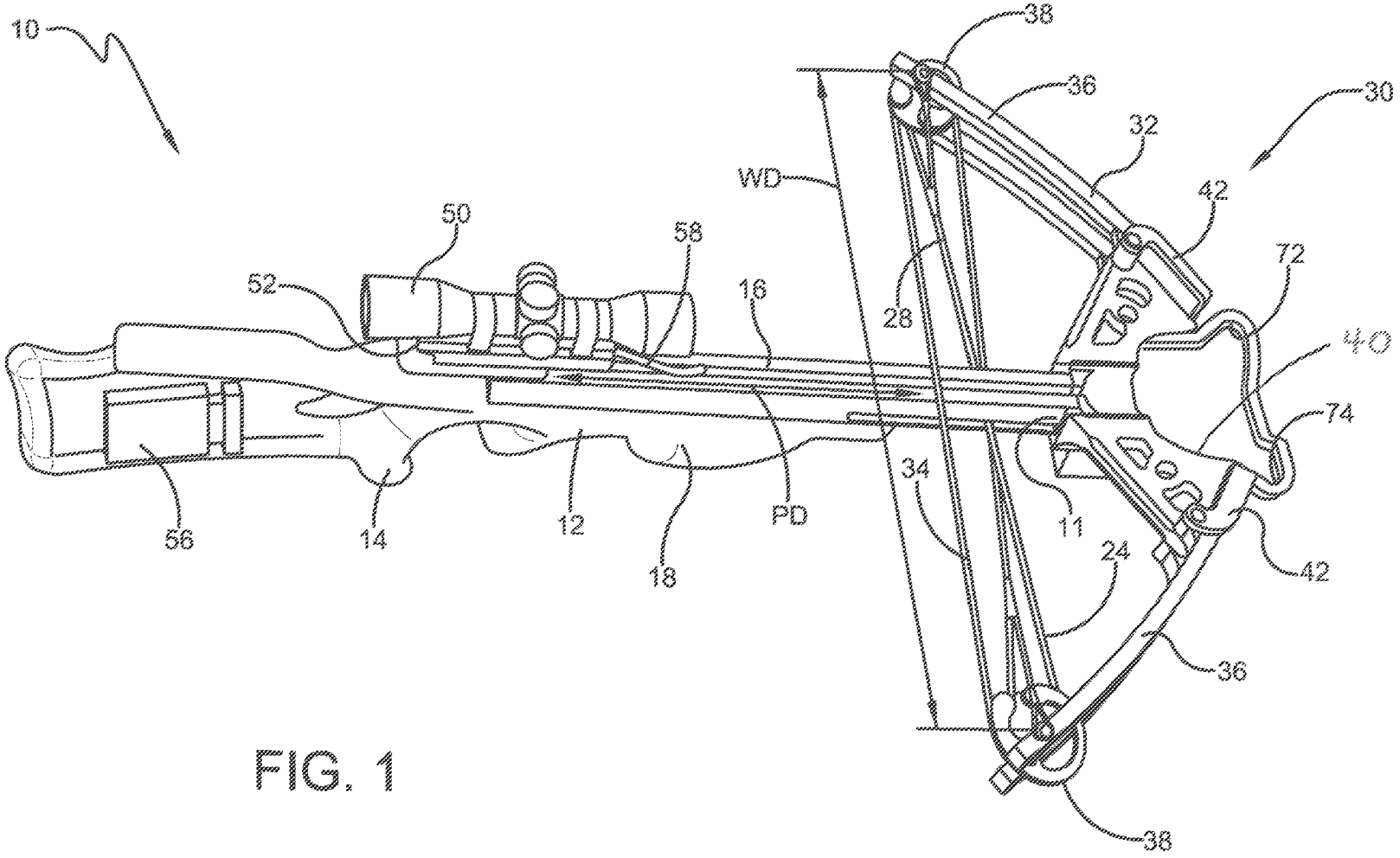
FIG. 1 is a view of one non-limiting embodiment of a crossbow.

The following definitions are controlling for the disclosed subject matter:

"Arrow" means a projectile that is shot with (or launched by) a bow assembly.

"Bow" means a bent, curved, or arched object.

"Bow Assembly" means a weapon comprising a bow and a bowstring that shoots or propels arrows powered by the elasticity of the bow and the drawn bowstring.

"Bowstring" means a string or cable attached to a bow.

"Compound Bow" means a crossbow that has wheels, pulleys or cams at each end of the bow through which the 5 bowstring passes.

"Crossbow" means a weapon comprising a bow assembly and a trigger mechanism both mounted to a main beam.

"Draw Weight" means the amount of force required to draw or pull the bowstring on a crossbow into a cocked condition.

"Main Beam" means the longitudinal structural member of a weapon used to support the trigger mechanism and often other components as well. For crossbows, the main beam also supports the bow assembly. The main beam often comprises a stock member, held by the person using the weapon, and a barrel, used to guide the projectile being shot or fired by the weapon.

"Power Stroke" means the linear distance that the bowstring is moved between the uncocked condition and the cocked condition.

"Trigger Mechanism" means the portion of a weapon that shoots, fires or releases the projectile of a weapon. As applied to crossbows, trigger mechanism means any device that holds the bowstring of a crossbow in the drawn or cocked condition and which can thereafter be operated to release the bowstring out of the drawn condition to shoot an arrow.

"Weapon" means any device that can be used in fighting or hunting that shoots or fires a projectile including bow assemblies and crossbows.

DETAILED DESCRIPTION

Referring now to the drawings wherein the showings are for purposes of illustrating embodiments of the present subject matter only and not for purposes of limiting the same, and wherein like reference numerals are understood to refer to like components, provided are a crossbow, crossbow components, and a method of using a crossbow and crossbow components.

FIG. 1 shows a crossbow 10 according to one embodiment of the present subject matter. While the crossbow 10 shown uses a compound bow, it should be understood that this invention will work well with any type of crossbow chosen with sound judgment by a person of ordinary skill in the art. The crossbow 10 has a main beam 12 which may include a stock member 14, and a barrel 16. The main beam 12 may be made by assembling the stock member 14 and the barrel 16 together as separate components or, in another embodiment, the main beam 12 may be made as one piece. A handgrip 18 may be mounted to the main beam 12 in any conventional manner chosen with sound judgment by a person of ordinary skill in the art. The crossbow 10 also includes a bow assembly 30 adapted to propel an associated arrow and having a bow 32 and a bowstring 34. The bow 32 may include a set of limbs 36, 36 that receive the bowstring 34 in any conventional manner chosen with sound judgment by a person of ordinary skill in the art. For the embodiment shown, a pair of wheels, pulleys, or cams 38, 38 mounted to the limbs 36, 36 receive the bowstring 34 in a known manner. The bow may also include a riser 40 operatively engaged with the main bean 12 at forward end 11 thereof.

The riser 40 may comprise a set of limb pockets 42, 42 adapted to receive the limbs 36, 36, as shown in FIG. 1. The riser 40 may be symmetric and comprise an axis of bilateral symmetry 296. The riser 40 may be have a first side 40*a* and a second side 40*b* opposite the first side 40*a* across the axis of bilateral symmetry 296. The bow may include a first power cord 28 operatively engaging a cam with a limb or riser 40. The bow may include a second power cord 24 operatively engaging a cam with a limb or riser 40.

Without limitations, other crossbow components may be optionally used with a crossbow as provided herein. Without limitation, in some non-limiting embodiments, a crossbow 10 shown may include a scope 50 attached to a scope mount 52 that is supported on the main beam 12. Other optional components shown include a cocking unit 56 and an arrow retention member 58. In certain non-limiting embodiments, the riser 40 may have an opening 72 formed therein defining a foot stirrup 74 adapted for holding and balancing the crossbow by foot.

A crossbow 10 may have a power stroke distance PD. The distance between the pivot axes of the wheels, pulleys, or cams 38, 38 may be some distance WD.

Figure 2:
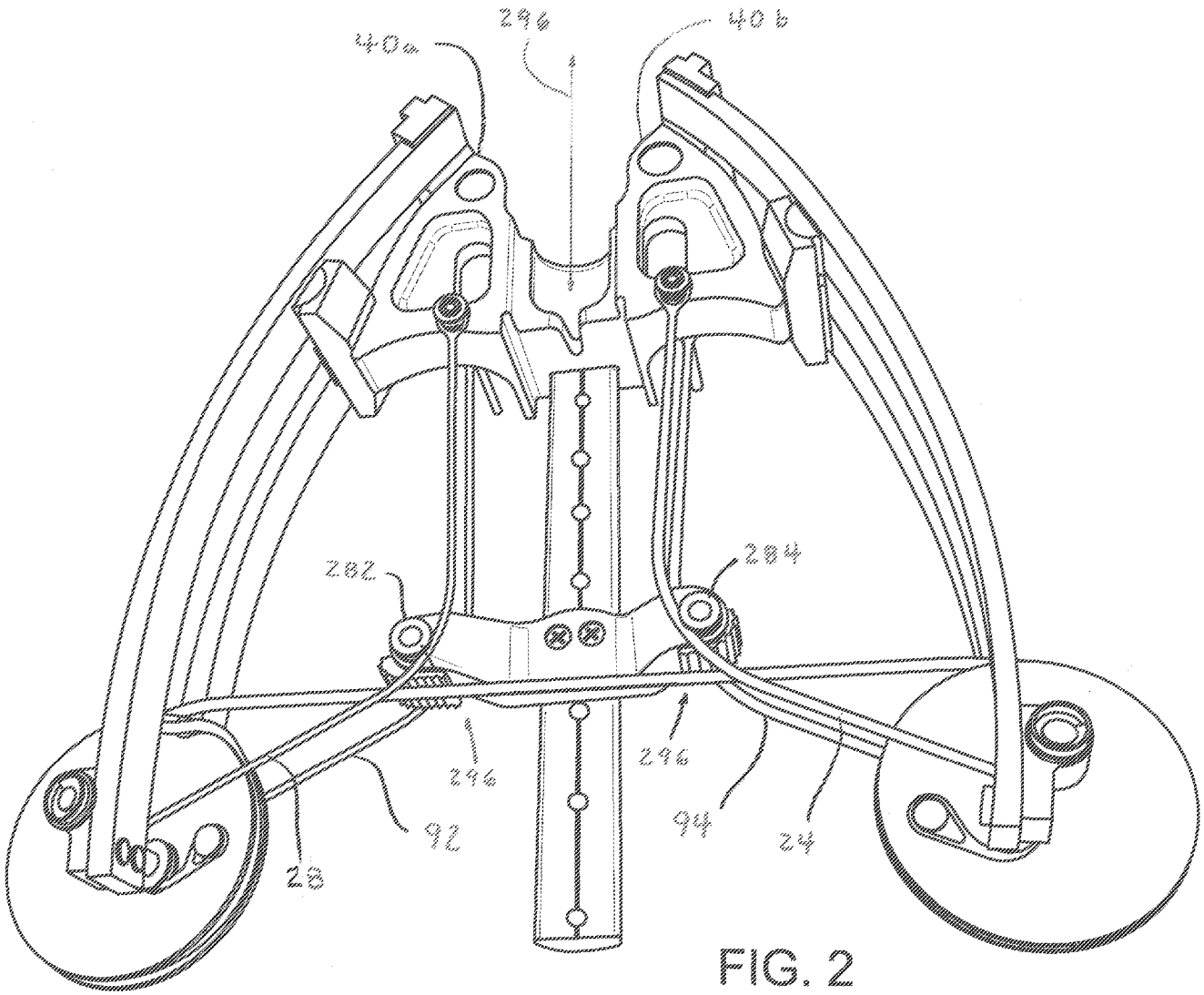
FIG. 2 is a view of a first non-limiting embodiment of a crossbow riser and limbs.
Figure 3:
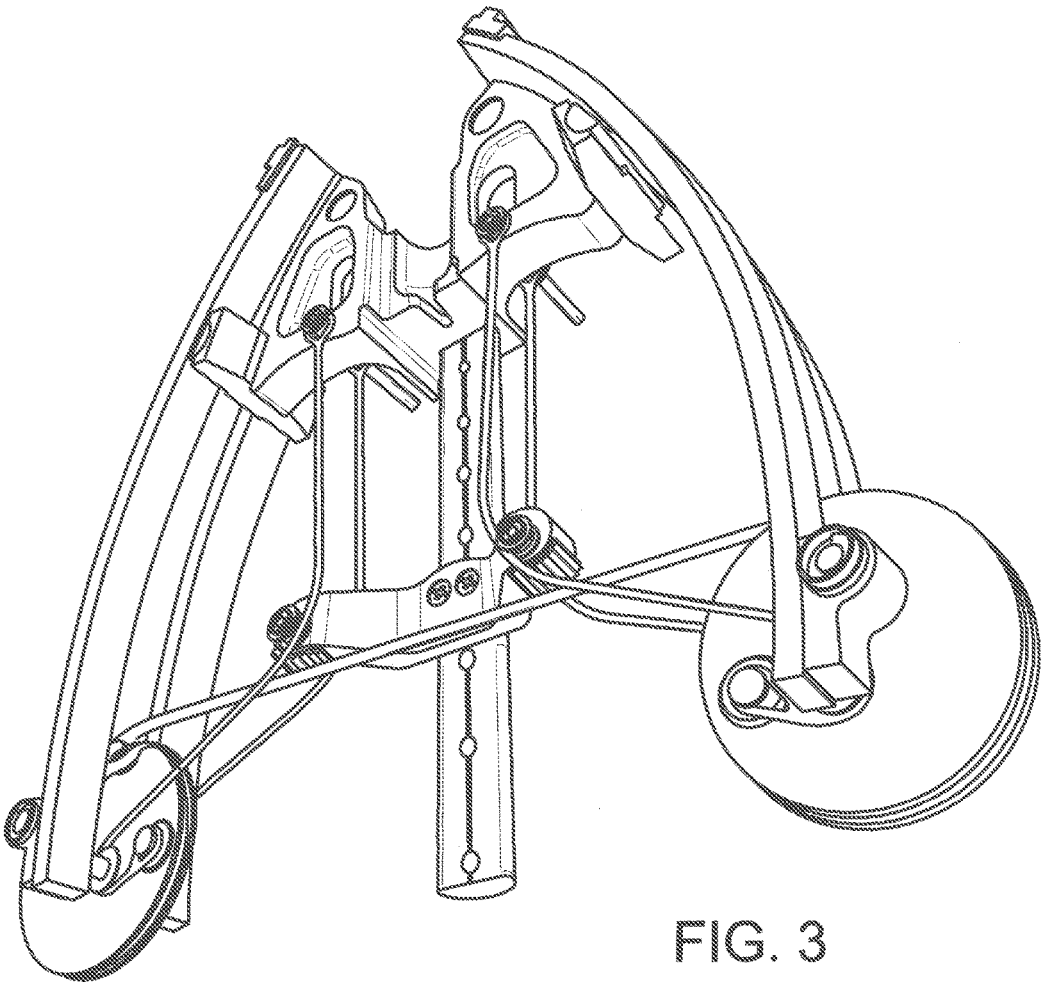
FIG. 3 is a view of the first non-limiting embodiment of a crossbow riser and limbs.
Figure 4:
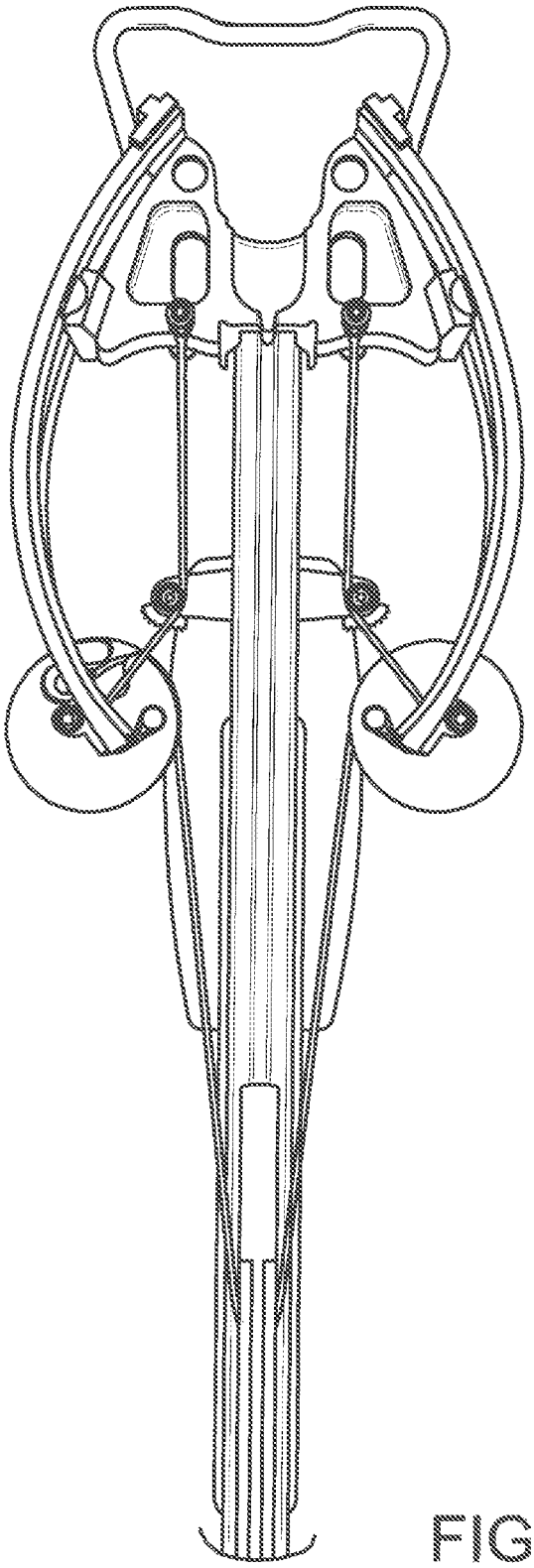
FIG. 4 is a view of a crossbow with the first non-limiting embodiment of a crossbow riser and limbs.
Figure 5:
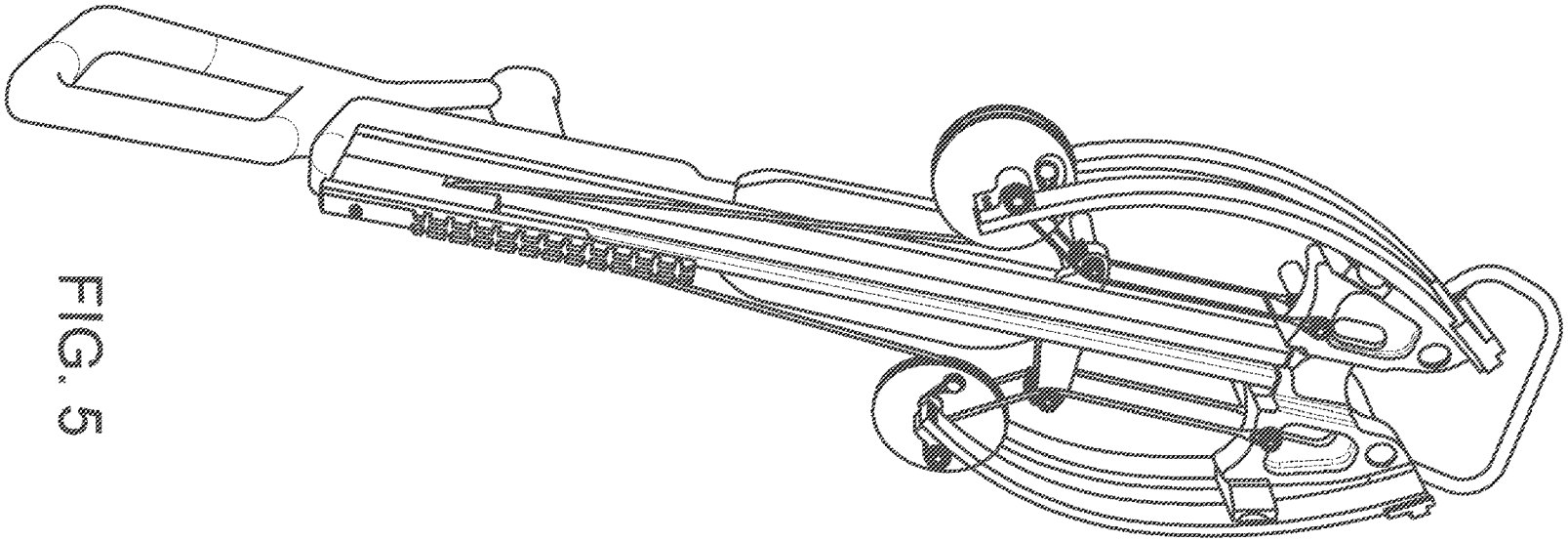
FIG. 5 is a view of a crossbow with the first non-limiting embodiment of a crossbow riser and limbs.
Figure 6:
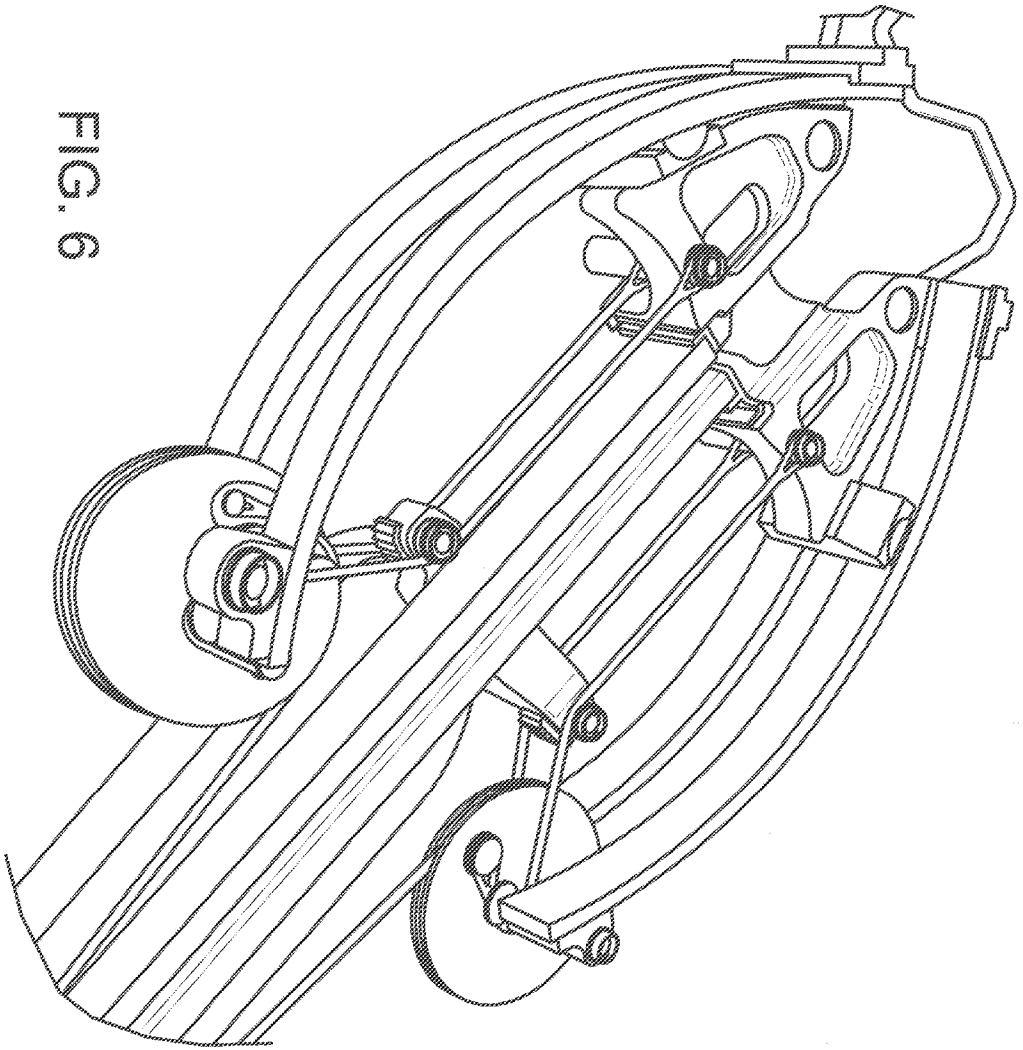
FIG. 6 is a view of a crossbow with the first non-limiting embodiment of a crossbow riser and limbs.
Figure 7:
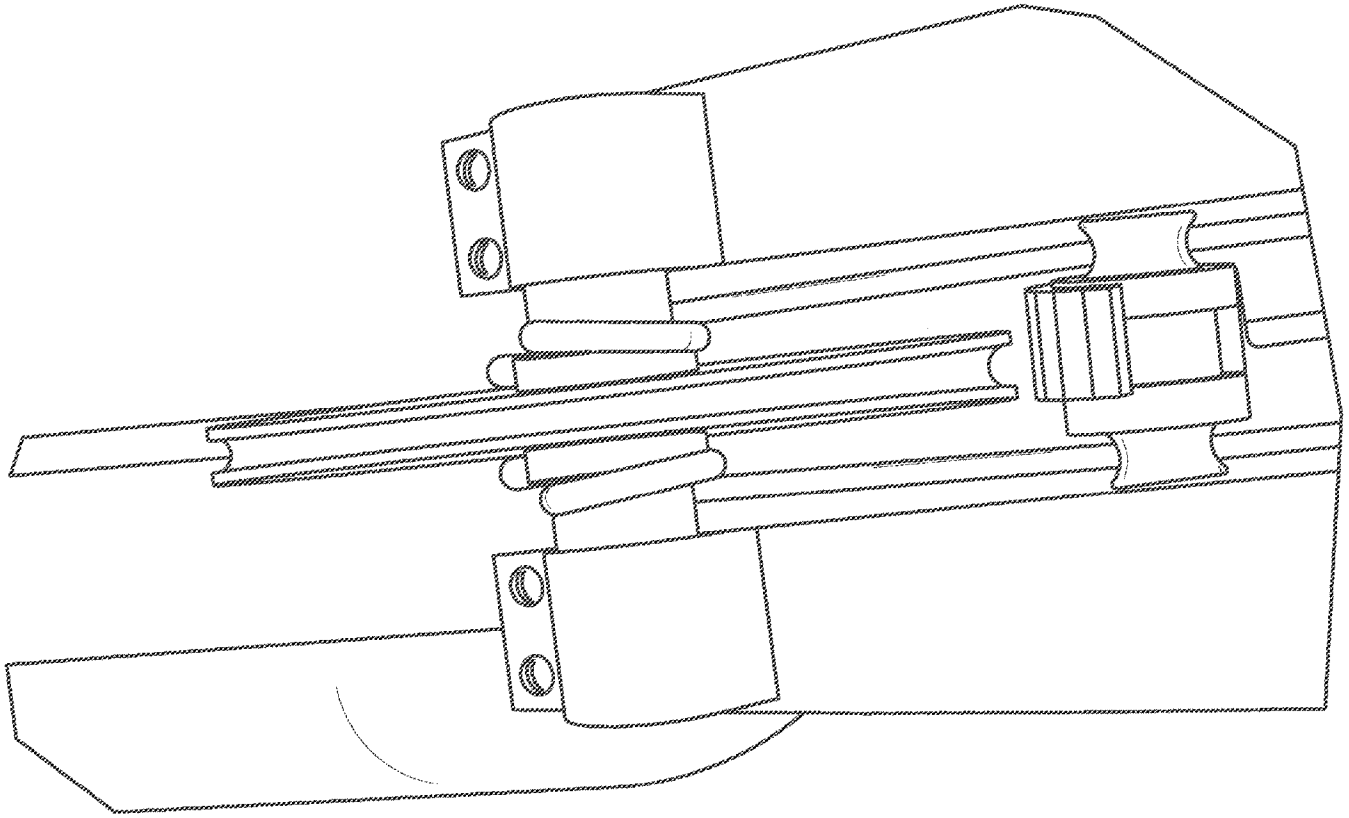
FIG. 7 is a close up view of one of the cams of a crossbow.
Figure 8:
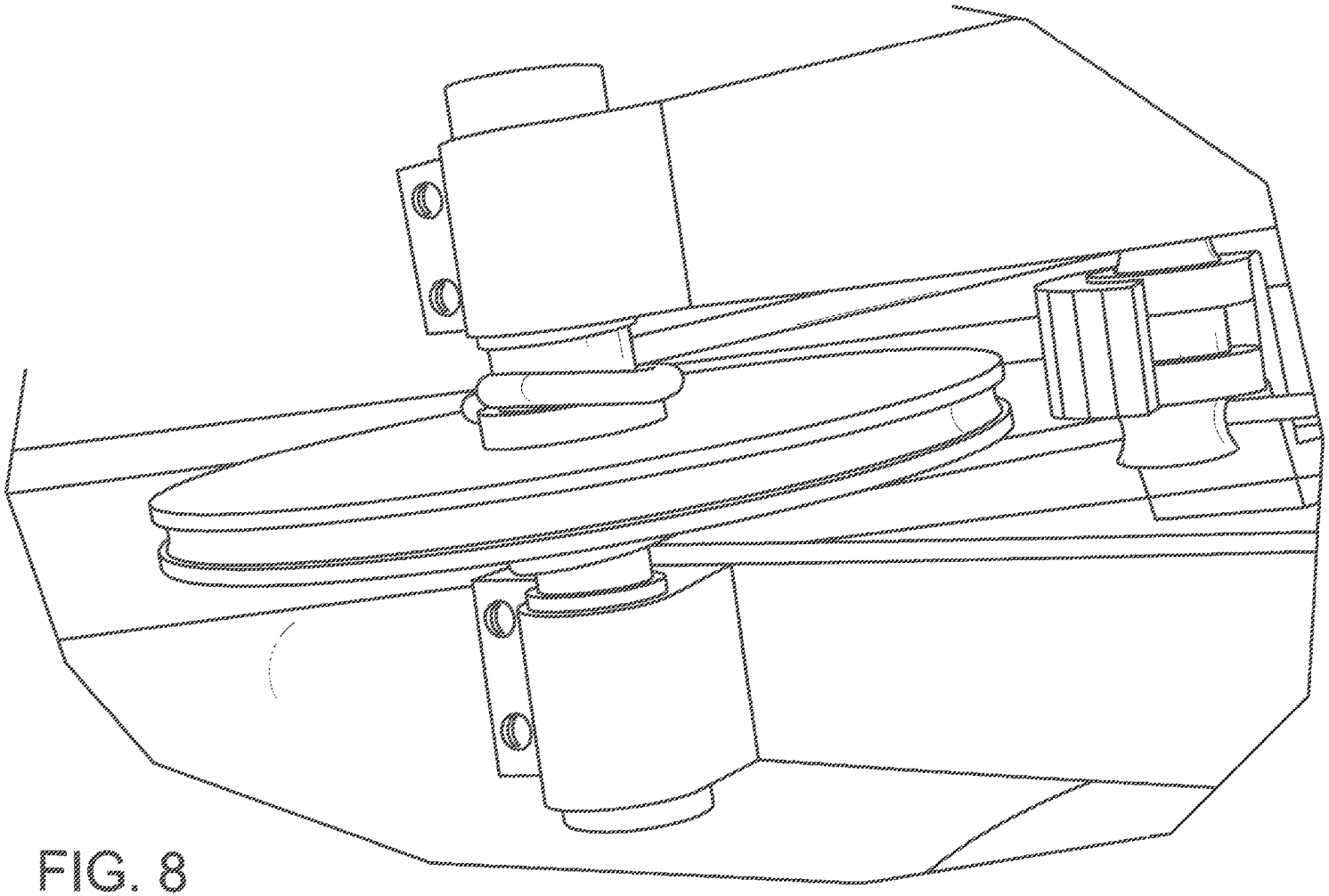
FIG. 8 is a close up view of one of the cams of a crossbow.
Figure 9:
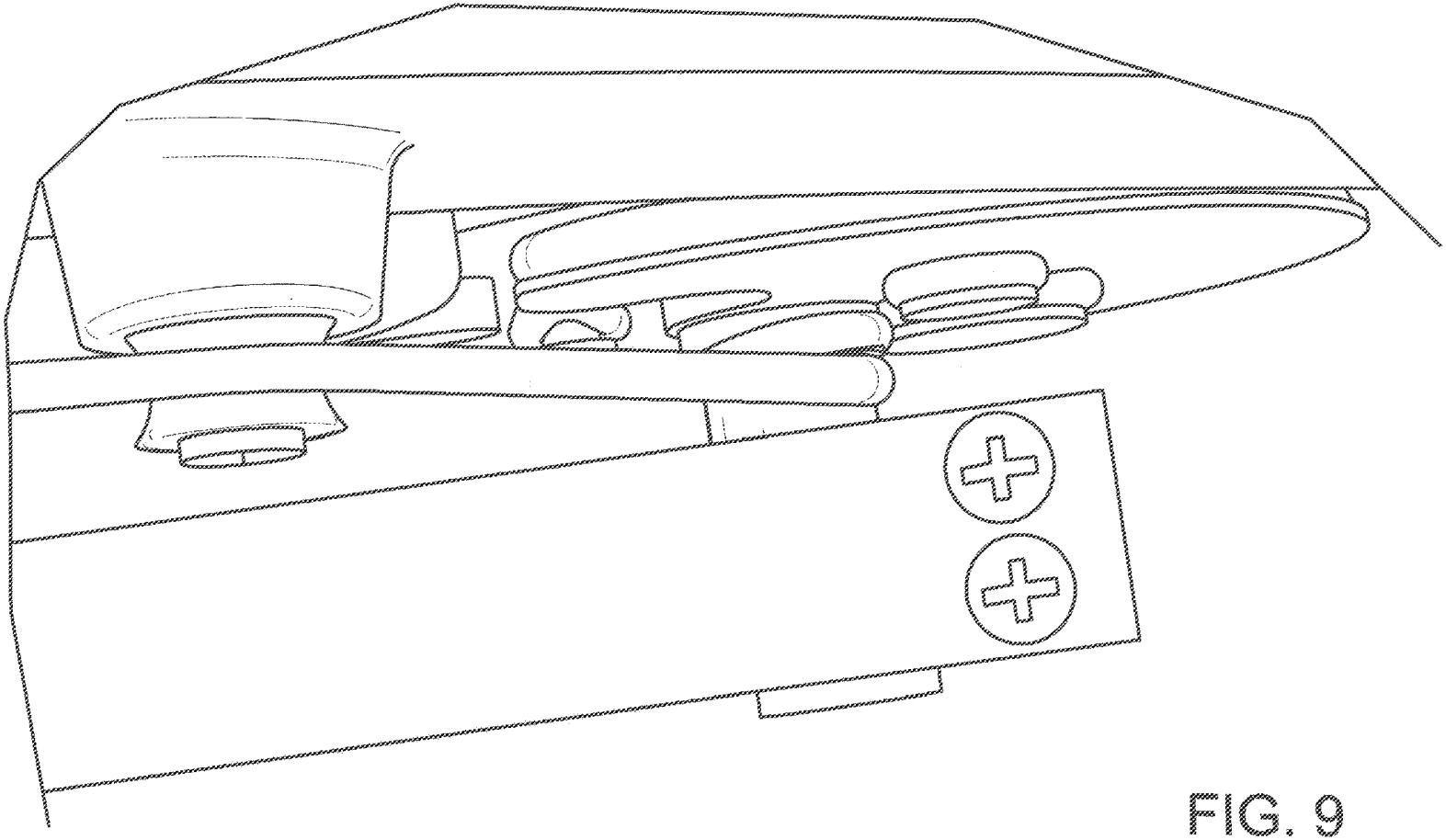
FIG. 9 is a close up view of one of the cams of a crossbow.

FIG. 2 shows an embodiments in which the power cords 28, 24 are each engaged with the riser 40. In the embodiment shown in FIG. 2, the power cords 28, 24 pass over an adjustable pulley set wherein the first power cord 28 passes over a first pulley 282 and the second power cord 24 passes over a first pulley 284. It should be understood that there may also be other powercords 92, 94 and pulleys 292 in some embodiments.

In some non-limiting embodiments, a crossbow may comprise a bow having a riser having a first side and a second side opposite the first side, a first limb set engaged to the first side, a second limb set engaged to the second side, a first cam set engaged to the first limb set, a second cam set engaged to the second limb set; an adjustable pulley set having at least a first pulley and a second pulley, the pulley set being selectably movable with respect to the first cam, or the second cam, or riser; a first power cord set extending from the first cam set and at least partially around the first pulley; and a second power cord set extending from the second cam set and at least partially around the second pulley.

Further examples consistent with the present subject matter are set out in the following numbered clauses.

Clause 1. A crossbow comprising a bow having a riser having a first side and a second side opposite the first side, a first limb set engaged to the first side, a second limb set engaged to the second side, a first cam set engaged to the first limb set, a second cam set engaged to the second limb set; an adjustable pulley set having at least a first pulley and a second pulley, wherein the pulley set is operationally engaged with and selectably movable with respect to the first cam, or the second cam, or the riser; a first power cord set extending from the first cam set and at least partially around the first pulley; and a second power cord set extending from the second cam set and at least partially around the second pulley.

Clause 2. A method of using crossbow components comprising, providing a bow having a riser having a first side, and a second side opposite the first side, a first limb set engaged to the first side, a second limb set engaged to the second side, a first cam set engaged to the first limb set, a second cam set engaged to the second limb set; providing an adjustable pulley set having at least a first pulley, and a second pulley, wherein the pulley set is operationally engaged with and selectably movable with respect to the first cam, or the second cam, or the riser; providing a first power cord set; providing a second power cord set; operationally engaging the first power cord set such that it extends from the first cam set, and at least partially around the first pulley; and operationally engaging the second power cord set such that it extends from the second cam set, and at least partially around the second pulley.

Clause 3. A crossbow comprising a bow having a riser having an axis of bilateral symmetry a first side and a second side opposite the first side across the axis of bilateral symmetry, a first limb set engaged to the first side and extending away from the axis of bilateral symmetry, a second limb set engaged to the second side and extending away from the axis of bilateral symmetry, a first cam set engaged to the first limb set, a second cam set engaged to the second limb set; an adjustable pulley set having at least a first pulley and a second pulley, the pulley set being operationally engaged with and selectably movable with respect to the first cam, or the second cam, or the riser; a first power cord set extending from the first cam set, at least partially around the first pulley, and to the first side of the riser; a second power cord set extending from the second cam set, at least partially around the second pulley, and to the second sider of the riser; and wherein the crossbow is adapted to be cocked in a cocked configuration wherein the first pulley is subjected to a net force from the first power cord set toward the riser, and the second pulley is subjected to a net force from the second power cord set toward the riser.

Numerous embodiments have been described, hereinabove. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof

What is claimed is:

1. A crossbow comprising a bow having a riser having an axis of bilateral symmetry, a first side and a second side opposite the first side, wherein the second side is opposite the first side across the axis of bilateral symmetry of the riser, a first limb set engaged to the first side, a second limb set engaged to the second side, a first cam set engaged to the first limb set, a second cam set engaged to the second limb set;

an adjustable pulley set having at least a first pulley pair and a second pulley pair, wherein the pulley set is operationally engaged with and selectably movable with respect to the first cam, or the second cam, or the riser;

a first power cord set extending from the first cam set and at least partially around the first pulley pair;

a second power cord set extending from the second cam set and at least partially around the second pulley pair; and wherein the first power cord set has a top first side power cord above the riser, and a bottom first side power cord below the riser;

wherein the second power cord set has a top second side power cord above the riser, and a bottom second side power cord below the riser;

wherein the first pulley pair has
a top first side pulley above the riser, and
a bottom first side pulley below the riser;
wherein the second pulley pair has
a top second side pulley above the riser, and
a bottom second side pulley below the riser;
wherein the crossbow is adapted to be cocked in a cocked configuration wherein the first pulley pair is subjected to a net force from the first power cord set toward the riser and the second pulley pair is subjected to a net force from the second power cord set toward the riser; and
wherein one end of each power cord is attached to the riser.

2. The crossbow of claim 1 wherein, the first limb set extends away from the axis of bilateral symmetry of the riser.

3. The crossbow of claim 2 wherein, the second limb set extends away from the axis of bilateral symmetry of the riser.

4. The crossbow of claim 3 wherein, the first pulley pair can be selectably positioned along a path parallel to the axis of bilateral symmetry.

5. The crossbow of claim 4 wherein, the second pulley pair can be selectably positioned along a path parallel to the axis of bilateral symmetry.

6. The crossbow of claim 5 wherein, the first power cord set extends from the first cam set, at least partially around the first pulley pair, and to the first side of the riser.

7. The crossbow of claim 6 wherein, the second power cord set extends from the second cam set, at least partially around the second pulley pair, and to the second side of the riser.

8. The crossbow of claim 7 wherein, the first pulley pair and the second pulley pair are selectably engageable by threaded fastener at any of a multitude of threaded receptacles on a track.

9. A method of using crossbow components comprising,
providing a bow having
a riser having
an axis of bilateral symmetry,
a first side, and
a second side opposite the first side,
wherein the second side is opposite the first side across the axis of bilateral symmetry of the riser,
a first limb set engaged to the first side,
a second limb set engaged to the second side,
a first cam set engaged to the first limb set,
a second cam set engaged to the second limb set;
providing an adjustable pulley set having
at least a first pulley pair, and
a second pulley pair,
wherein the pulley set is operationally engaged with and selectably movable with respect to
the first cam, or
the second cam, or
the riser;
providing a first power cord set;
providing a second power cord set;
operationally engaging the first power cord set such that it extends from the first cam set, and at least partially around the first pulley pair;
operationally engaging the second power cord set such that it extends from the second cam set, and at least partially around the second pulley pair; and
wherein the first power cord set has
a top first side power cord above the riser, and
a bottom first side power cord below the riser;
wherein the second power cord set has
a top second side power cord above the riser, and
a bottom second side power cord below the riser;
wherein the first pulley pair has
a top first side pulley above the riser, and
a bottom first side pulley below the riser;
wherein the second pulley pair has
a top second side pulley above the riser, and
a bottom second side pulley below the riser; and
further comprising cocking the crossbow wherein the resulting cocked crossbow configuration subjects the first pulley to a net force from the first power cord set toward the riser and subjects the second pulley to a net force from the second power cord set toward the riser; and
wherein one end of each power cord is attached to the riser.

10. The method of using crossbow components of claim 9 wherein, the first limb set extends away from the axis of bilateral symmetry of the riser.

11. The method of using crossbow components of claim 10 wherein, the second limb set extends away from the axis of bilateral symmetry of the riser.

12. The method of using crossbow components of claim 11 further comprising operationally engaging the first power cord set such that it extends from the first cam set, at least partially around the first pulley pair, and to the first side of the riser.

13. The method of using crossbow components of claim 12 further comprising operationally engaging the second power cord set such that it extends from the second cam set, at least partially around the second pulley pair, and to the second side of the riser.

14. The method of using crossbow components of claim 13 further comprising operationally engaging a bowstring between the first cam set and the second limb set.

15. A crossbow comprising
a bow having
a riser having
an axis of bilateral symmetry
a first side and
a second side opposite the first side across the axis of bilateral symmetry,
a first limb set engaged to the first side and extending away from the axis of bilateral symmetry,
a second limb set engaged to the second side and extending away from the axis of bilateral symmetry,
a first cam set engaged to the first limb set,
a second cam set engaged to the second limb set;
an adjustable pulley set having at least a first pulley and a second pulley, the pulley set being operationally engaged with and selectably movable with respect to
the first cam, or
the second cam, or
the riser;
a first power cord set extending
from the first cam set,
at least partially around the first pulley, and
to the first side of the riser;
a second power cord set extending
from the second cam set,
at least partially around the second pulley, and
to the second sider of the riser; and
wherein the crossbow is adapted to be cocked in a cocked configuration wherein the first pulley is subjected to a net force from the first power cord set toward the riser, and the second pulley is subjected to a net force from the second power cord set toward the riser; and wherein one end of each power cord set is attached to the riser.

* * * * *